United States Patent [19]

Rice et al.

[11] Patent Number: 4,681,054

[45] Date of Patent: Jul. 21, 1987

[54] MARINE VESSEL AND METHOD FOR TRANSPORTING A VEHICLE

[75] Inventors: Mark S. Rice, Washington, D.C.; Paul D. Hunt, Alexandria, Va.

[73] Assignee: CACI, Inc. - Federal, Arlington, Va.

[21] Appl. No.: 770,218

[22] Filed: Aug. 28, 1985

[51] Int. Cl.[4] ..... B63B 39/00

[52] U.S. Cl. ..... 114/124; 114/258; 114/270; 254/323; 414/679

[58] Field of Search ..... 114/258-261, 114/124, 70, 72, 210, 242, 344, 270, 144 A, 146, 357, 121, 125; 440/11, 3; 254/323, 325; 414/538, 559, 679; 213/220, 221; 280/480

[56] References Cited

U.S. PATENT DOCUMENTS

| | | | |
|---|---|---|---|
| 1,339,628 | 5/1920 | Selah . | |
| 1,853,069 | 4/1932 | Minorsky | 114/124 |
| 2,341,866 | 2/1944 | Higgins | 114/70 X |
| 2,416,753 | 3/1947 | Hicks | 114/70 X |
| 2,982,427 | 5/1961 | Mulcahy et al. | 213/221 |
| 3,186,371 | 6/1965 | Moore | 114/125 |
| 3,426,718 | 2/1969 | Slager et al. . | |
| 4,014,280 | 3/1977 | Laxo . | |
| 4,099,280 | 7/1978 | Hoppe et al. | 114/357 |
| 4,266,800 | 5/1981 | Hawkins | 280/480 X |
| 4,309,914 | 1/1982 | Hiersig et al. | 440/3 X |
| 4,331,323 | 5/1982 | Sekimori et al. | 293/117 X |
| 4,453,485 | 6/1984 | Houghton-Brown et al. | 114/114 A |

FOREIGN PATENT DOCUMENTS

| | | | |
|---|---|---|---|
| 2844043 | 4/1980 | Fed. Rep. of Germany | 114/270 |
| 880874 | 11/1981 | U.S.S.R. | 114/124 |

*Primary Examiner*—Joseph F. Peters, Jr.
*Assistant Examiner*—Paul E. Salmon
*Attorney, Agent, or Firm*—Parkhurst & Oliff

[57] ABSTRACT

A marine vessel for amphibious operations carries a land military vehicle which is secured by a cable and winch arrangement to the deck of the vessel and also positioned by means of a torsion bar. The military vehicle can be moved fore and aft to vary the longitudinal center of gravity of the vessel as a function of water speed so as to a transition the hydrodynamic hump of the vessel to obtain maximum speed with minimum power. The movement of the vehicle is controlled by the vehicle operator who manipulates the recovery winch. The vessel is under the control of the vehicle operator by means of a flexible control cable and a control box which is disposed within the vehicle.

5 Claims, 7 Drawing Figures

MARINE VESSEL AND METHOD FOR TRANSPORTING A VEHICLE

BACKGROUND AND SUMMARY OF THE INVENTION

The present invention relates to a marine vessel for transporting a military vehicle, more particularly, to a planing hull that carries a light armored vehicle during the first phase of an amphibious assault in which the longitudinal center of gravity of the combined hull and vehicle can be varied as a function of the water speed. More particularly, the present invention relates to a method for transitioning the hydrodynamic hump of a marine vessel having a planing hull to obtain maximum speed with minimum power.

In amphibious warfare, many different kinds of marine vessels, usually referred to as landing craft, have been employed for the purpose of transporting cargo and personnel from a mother ship or base to a landing upon a beach. A wide variety of vehicles, both wheeled and with tracks, which were necessary to carry out the designated mission have been transported by these landing craft to positions upon a beach. Such cargo landing craft are rather ponderous in structure and move at slow speeds through the water. Thus, a rather long period of time is required to travel from either a base or mother ship to the beach landing area. Since the mother ship may be anchored about 20 miles from the landing beach, the long time required to make the trip from the mother ship to the beach is undesirable and may even cause discomfort and illness among the personnel.

It was then considered that marine vessels each carrying a single vehicle, such as a light armored vehicle, might be utilized, particularly in the first phase of an amphibious assault. The concept of using a planing hull that carries a single vehicle has thus been explored and various such hulls have been investigated. Such a marine vessel for a single military vehicle, or a planing hull, should be simple in construction, easy to operate, provide quick loading and unloading of the vehicle and be capable of stable travel through the water when loaded at speeds of up to 20 knots.

It is therefore the principal object of the present invention to provide a novel and improved marine vessel for transporting a military vehicle in an amphibious operation.

It is another object of the present invention to provide such a marine vessel wherein the longitudinal center of gravity of such a vessel loaded with a vehicle can be controlled as a function of the vessel water speed.

It is a further object of the present invention to provide such a marine vessel which has retractable wheels and which can be towed up on the beach to function as a fuel supply depot, a fuel pumping station, a source of power, maintenance or repair facility, or an armored command post.

It is an additional object of the present invention to provide such a marine vessel which is simple in construction, easy to operate and maintain and which can be loaded or unloaded with a minimum of effort and without exposing the personnel manning the vehicle to enemy fire.

According to one aspect of the present invention, a method for transitioning the hydrodynamic hump of the marine vessel having a planing hull to obtain maximum speed with minimum power comprises the steps of positioning movable ballast at a predetermined aft first position in the vessel to obtain a first vessel trim angle at a predetermined vessel water speed less than the hump speed of the vessel; and shifting the ballast forwardly in the vessel to change the longitudinal center of gravity of the vessel in dependence on the vessel water speed as the vessel water speed approaches the hump speed of the vessel so as to obtain a second vessel trim angle for passage of the vessel through the hump speed to the running speed of the vessel.

According to another aspect of the present invention, a marine vessel for transporting a military vehicle in an amphibious assault may comprise a hull having means thereon connectible to a vehicle on the deck of the hull for securing the vehicle in position thereon. Means are also provided for moving the secured vehicle fore and aft with respect to the water speed of the vessel in order to vary longitudinally the center of gravity. The cable from the recovery winch on the front of the vehicle is passed under a deck fairlead to be attached to a cable anchor having a hydraulic release so that winding of the winch will move the vehicle aft against a torsion spring or hydraulic structure which is capable of moving the vehicle fore when the winch is unwound.

BRIEF DESCRIPTION OF THE DRAWINGS

Other objects and advantages of the present invention will be apparent upon reference to the accompanying description when taken in conjunction with the following drawings, which are exemplary, wherein.

DETAILED DESCRIPTION OF THE PREFERRED EMBODIMENT

Proceeding next to the drawings wherein like reference symbols indicate the same parts throughout the various views, a specific embodiment and modifications of the present invention will be described in detail.

Figure 1:
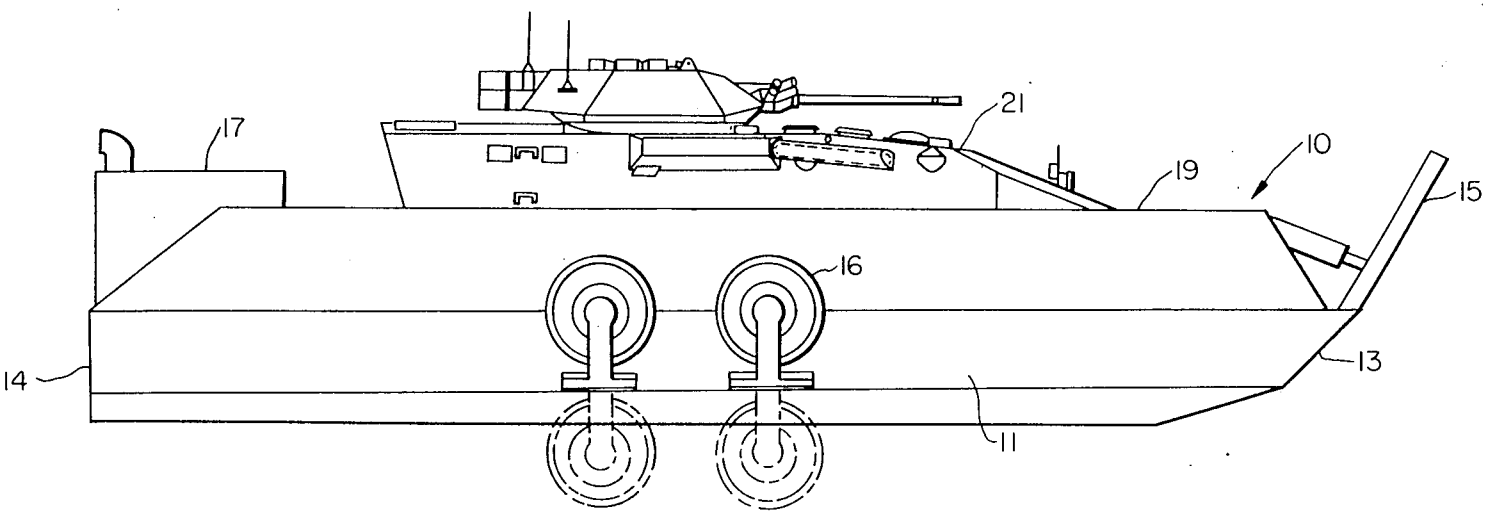
FIG. 1 is a side elevational view of the marine vessel according to the present invention carrying a vehicle and with the wheels in retracted position.
Figure 2:
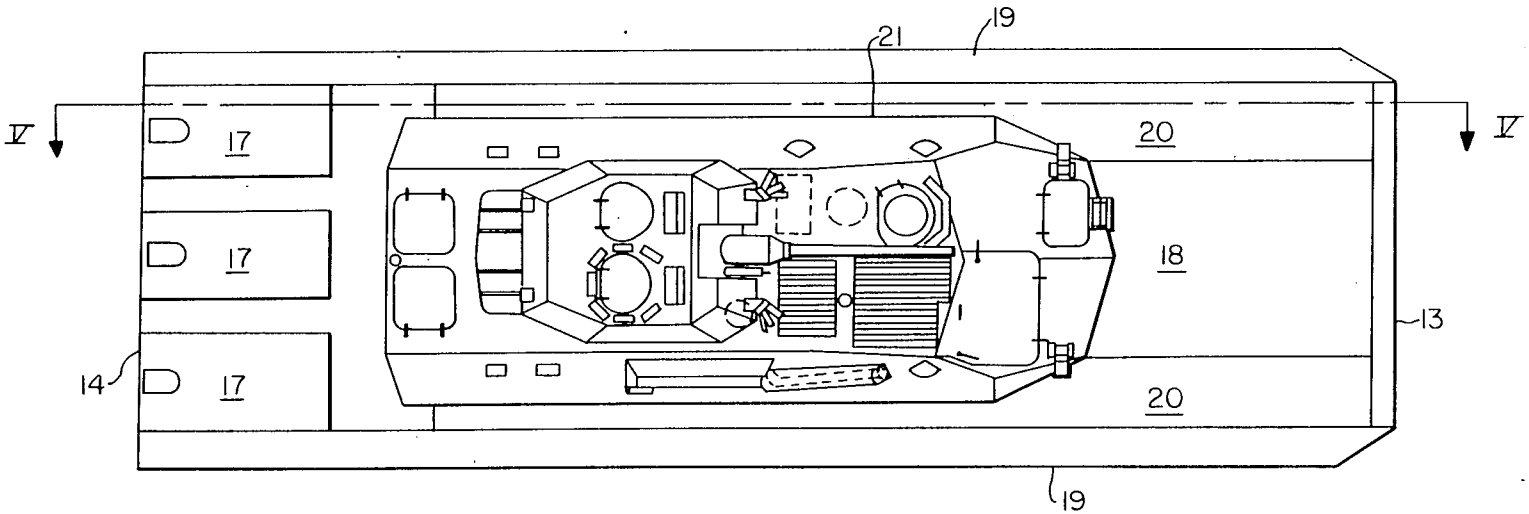
FIG. 2 is a top plan view of the vessel and vehicle as shown in FIG. 1.
Figure 3:
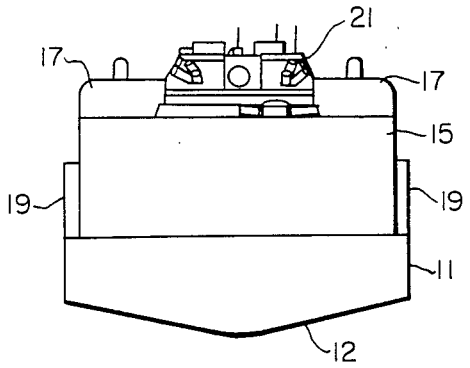
FIG. 3 is a front elevational view of the vessel and vehicle shown in FIG. 1.

In FIG. 1, there is indicated generally at 10 a marine vessel according to the present invention and constructed with a planing hull 11. The planing hull has a vee-shaped configuration 12 that may be seen in FIG. 3 and this shape hull is preferred from a hydrodynamic viewpoint. However, the hull in cross section could be tunnel-shaped so as to facilitate beaching of the vessel and also to provide better stability on the beach.

The vessel 10 is provided with a bow portion 13 and a stern portion 14. A bow ramp 15 is pivotably mounted at the bow 13. The vessel is also provided with two pairs of retractable wheels 16 shown in solid lines in FIG. 1 in their retracted positions. The wheels are located at substantially the center portion of the vessel so as to facilitate maneuvering of the vessel when it is being towed upon the beach without actual steering of the wheels. The wheels are provided with mechanical locks which are locked when the vehicle is being unloaded from the vessel.

At the stern portion 14 the vessel is powered by three diesel engines 17 of approximately 300–400 horsepower each. Power is transmitted from the engines by means of a belt drive to water-jets or ducted propellers as known in the art. While not shown in the drawings, the bottom of the hull is provided with three flush inlets for the jets. When jets are used, the vessel is reversed by the use of deflecting buckets at the jet exhaust. These buckets are retractable and are similar in function and structure to those employed on aircraft jet engines.

Figure 4:
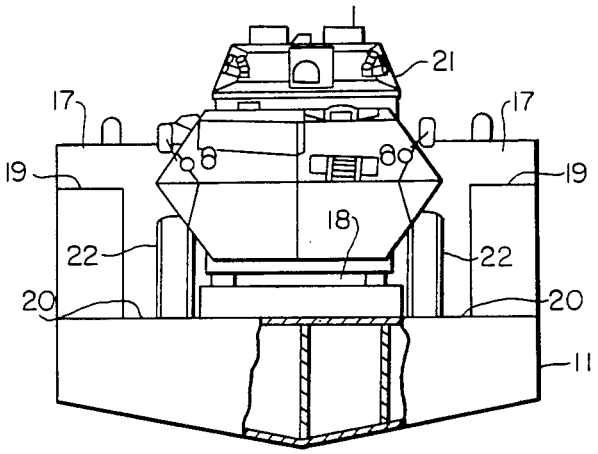
FIG. 4 is a view similar to that of FIG. 3 but with the bow ramp removed and a portion of the hull cut away to illustrate the hollow construction.

The hull is made of steel or aluminum plates or sheets of composite materials in a manner so as to be hollow as shown in FIG. 4.

The upper surface of the hull 11 constitutes a deck 18 and extending longitudinally along the longitudinal edges of the deck are side roll blisters 19 of metal or FRP (composite) which are preferably filled with an air plastic foam so as to increase the bouyancy of the vessel. The blisters 19 may be integral with the hull or be detachable therefrom. The blisters are vertical extensions on the sides of the hull.

The deck 18 is also formed with a pair of longitudinally extending channels 20 for receiving the wheels or tracks of a military vehicle 21. By seating the wheels of a vehicle in these longitudinal channels, the vehicle is prevented from lateral movement during transportation but is capable of controlled longitudinal movement.

Secured on the vessel 10 is a military vehicle 21 which in this embodiment is a light armored vehicle known as a LAV-25 manufactured by General Motors and weighing approximately 14 tons when combat loaded. The vehicle 21 has wheels 22 which are disposed in the wheel channels 20. At the front of the vehicle there is located a conventional recovery winch 23 (FIG. 5) from which extends a cable 24. The cable 24 passes under a deck fair lead 25 to be attached to a cable anchor 26 which is fixed to the deck and provided with a hydraulic release cable for detachment of the cable 24 from the anchor 26.

Figure 5:
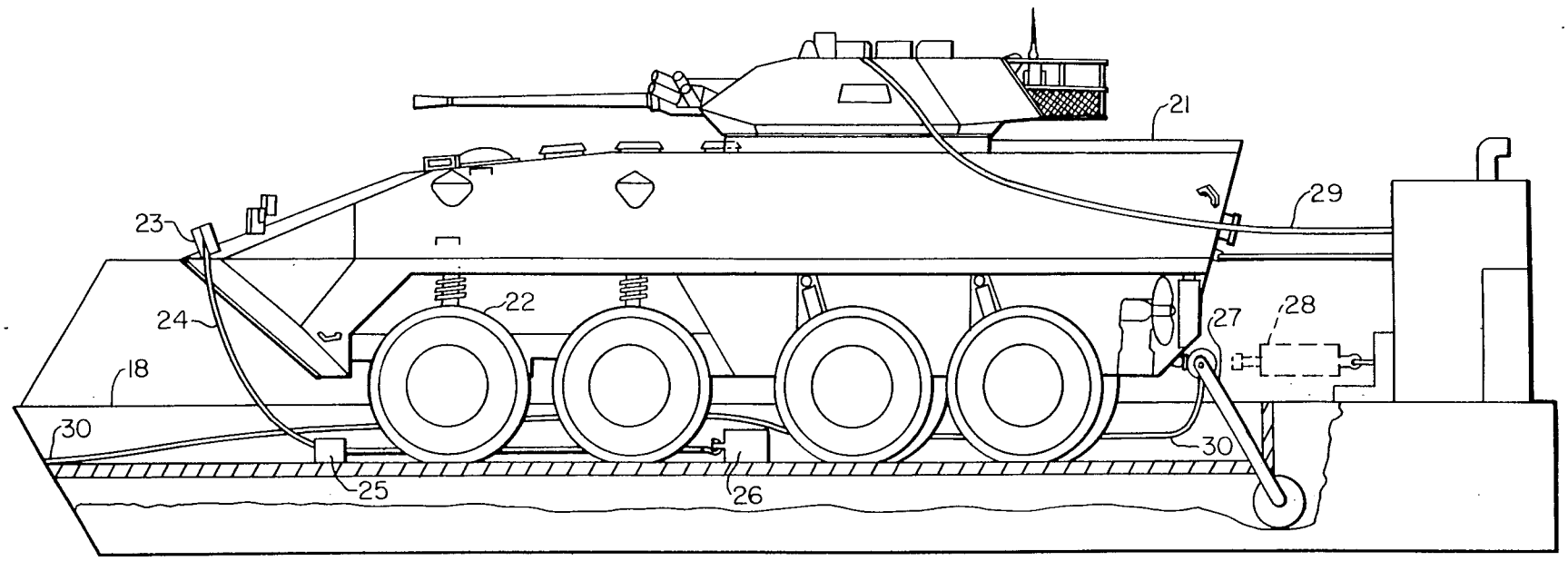
FIG. 5 is a longitudinal sectional view taken along the line V—V of FIG. 2 and showing the vehicle secured on the vessel.
Figure 6:
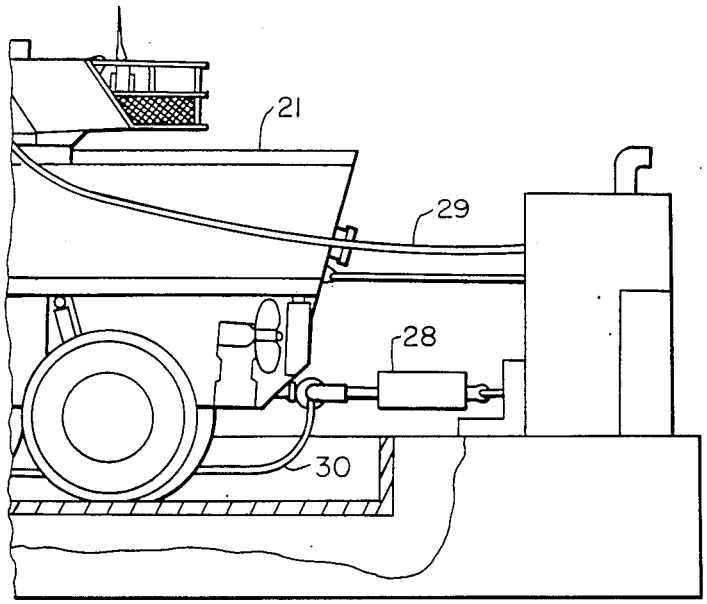
FIG. 6 is the right end portion of FIG. 5 but showing a further structure for securing the vehicle on the vessel.
Figure 7:
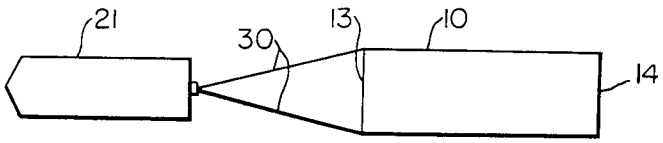
FIG. 7 is a top plan view showing schematically the vehicle towing the vessel upon the beach.

At the stern portion of the vessel there is positioned a spring loaded torsion bar 27 which acts against the rear end of the vehicle 21 to urge it forward in the manner as shown in FIG. 5. The bar 27 may also be attached to the vehicle trailer hitch or act directly against the body or wheels of the vehicle. When the cable 24 is tightened so as to remove all slack and the torsion bar 27 bears against the end of the vehicle, the vehicle will be secured in position against any fore and aft movement of the vessel except for only limited movement brought about by heavy sea conditions.

As a modification, in place of the torsion bar 27, there may be employed a push-pull hydraulic cylinder 28 which is attached to the trailer hitch of the vehicle. The limits of the cylinder are set to correspond to the required travel of the vehicle to vary the center of gravity and is provided with a manual release. There is a door at the rear of the vehicle so that the cyliner 28 can be readily released from the hitch by personnel opening the door and releasing the manual release of the hydraulic cylinder without exposure to enemy fire which is generally coming from the direction of the bow of the vessel.

As a further modification, an electric push-pull actuator may be used and arranged in the same manner as the hydraulic cylinder 28. Such hydraulic or electric actuators could also be equipped with remotely actuated releases to detach automatically from the vehicle hitch thereby obviating the necessity for the vehicle personnel to open the rear door.

After the vehicle 21 has been loaded upon the vessel 10, control of the vessel is from within the vehicle by means of a control box at the end of a control cable 29 in the form of an umbilical cord which is connected to the engine and other operating components of the vessel. Thus, the vessel is actually controlled by the crew of the vehicle who are within the vehicle and thus unexposed.

When the vehicle 21 is loaded upon the vessel, a flexible towing bridle 30 in the form of a cable is connected from the rear hitch of the vehicle to the bow of the vessel.

After the vessel has been loaded with its military vehicle which is secured in position as shown, the vessel then departs for the beach and may attain a top speed of about 20 Knots. When the vehicle is positioned upon the vessel so that the vessel is level in the water at a standstill, the longitudinal center of gravity of the loaded vessel will be somewhat aft of the center of the waterplane such that the vessel assumes a "bow-up" trim. When the loaded vessel is proceeding at low speeds, the longitudinal center of gravity must be moved astern in order to prevent the bow from nosing into oncoming seas. However, as the loaded vessel accelerates to top speed, the trim will increase due to hydrodynamic forces. At the so-called hump speed the trim angle may be 15–17 degrees. In order to decrease this angle to pass through the hump speed, a running trim angle of 5–7 degrees is necessary. To accomplish this change in trim the vehicle is shifted forwardly but still remains secured on the vessel. The range of longitudinal movement of the vehicle is approximately 2–4 feet. To shift the vehicle forwardly, the tension on the cable 24 is lessened by unwinding the winch 23 and the vehicle will be moved forwardly by the action of the spring loaded torsion bar 27. This forward movement of the vehicle is under the control of the commander of the vehicle within the vehicle and is achieved until the center of gravity has been moved longitudinally in a forward direction to obtain the proper running trim of the vessel. The cable 24 remains secured at all times to the cable anchor 26. It is apparent that by winding the cable 24 by means of the winch 23, the vehicle will be moved aft against the spring loaded torsion bar 27.

When the vessel reaches the beach, the wheels 16 may be deployed downwardly and locked in position so as to anchor the vessel firmly within the sand. The cable 24 is disconnected from the cable anchor 26 and the rear hitch of the vehicle disconnected from the torsion bar 27 or hydraulic cylinder 28, whichever embodiment has been employed. The vehicle is then driven forwardly against the bow ramp 15 which is maintained in its uppermost position as shown in FIG. 1 by a torsion spring. As the vehicle is driven forwardly, it will push the ramp 15 down and the ramp will then return to its original upright position after the vehicle has passed over the ramp. This torsion spring arrangement for the bow ramp eliminates an additional ramp mechanism. However, if desired, such a ramp mechanism can be used. The ramp preferably is provided with a rachet release so as to release tension to enable the ramp to be lowered when the vehicle is initially loaded upon the vessel.

As the vehicle 21 moves off of the vessel, the vessel will be towed upon the beach by means of the towing bridle 30 which still remains connected to the trailer hitch of the vehicle and the bow of the vessel. When the vessel has been maneuvered to its designated position, the bridle is released and the vehicle proceeds by itself on its mission.

When thus stationed upon the beach, the vessel which has the hollow hull as described above, may function as a fuel depot by being initially loaded with a supply of liquid fuel within the hollow hull. Also, the ship's engines can be used to power large fuel pumps to move fuel through a long pipeline.

The vessel may also be provided with belt driven electric generators and may thus function as a source of electrical energy after it has been deployed upon the beach. For this purpose, the vessel may also be provided with a distribution and power control panel so as to function as a source of power in the field for military purposes. If it is intended that the vessel function as a command post after the vessel has been towed to a designated spot on the beach, the construction of the hull is modified to provide a compartment or enclosure therein of sufficient size to accommodate several persons together with the necessary communications and other equipment. This compartment may be constructed into the hull or may sit on the deck after being brought ashore separately.

This same modified hull with the enclosure for personnel could also be used to provide the vessel with a capability for return to the mother ship or base after its vehicle has been unloaded. Under these conditions, the control box would be positioned into the personnel enclosure and the vessel operated through the control box and flexible control cable 29. It is apparent that if it is intended that the vessel return to the mother ship, the vessel would not be drawn up onto the beach after the vehicle has been unloaded therefrom.

The vessel could then be used to transport freight, equipment, vans, containers for cargo or support facilities from a base or mother ship to the beach. The equipment may include mobile machine shops or other repair facilities.

Thus it can be seen that the marine vessel according to the present invention allows a land vehicle which is carried on its deck to be moved fore or aft to control the longitudinal center of gravity as a function of the vessel water speed. The vehicle is prevented from lateral movement on the ship by the wheel channels in the deck. Fore and aft movement of the vehicle is controlled by a winch that pulls a wire cable connected from the vessel to the vehicle. This winch/cable arrangement functions to prevent the vehicle from moving fore and aft as the vessel moves in the sea, the winch controls the longitudinal center of gravity as a function of vessel speed under the control of the vehicle operator, and functions as a source of wire and point of attachment for the towing bridle as the vehicle tows the vessel up upon the beach.

It will be understood that this invention is susceptible to modification in order to adapt it to different usages and conditions, and accordingly, it is desired to comprehend such modifications within this invention as may fall within the scope of the appended claims.

What is claimed is:

1. A method for transitioning the hydrodynamic hump of a marine vessel having a planing hull to obtain maximum speed with minimum power, the hydrodynamic hump being the hump in the drag versus speed relationship exhibited by the marine vessel as the marine vessel transitions from displacement to planing performance, said method comprising the steps of:

positioning movable ballast means at a predetermined aft first position in the vessel to obtain a first vessel trim angle at a predetermined vessel water speed less than the hump speed of the vessel;

shifting said ballast means forwardly in the vessel to change the longitudinal center of gravity of the vessel in dependence on the vessel water speed as the vessel water speed approaches the hump speed of the vessel so as to obtain a second vessel trim angle for passage of the vessel through the hump speed to the running speed of the vessel.

2. The method of claim 1 wherein said ballast means comprises cargo secured in the vessel by cargo mounting means operable to secure the cargo in selectable positions and to displace the cargo in fore and aft directions.

3. The method of claim 2 wherein said cargo mounting means comprises fore and aft securing means mounted on the vessel and releasably secured to said cargo, and at least one of said securing means is adjustable to shift the longitudinal position of said cargo between said first and a second predetermined position.

4. The method of claim 3 wherein said aft securing means comprises biasing means for urging said cargo in a forward direction and said fore securing means comprises adjustable restraining means for restraining said cargo against forward displacement beyond selectable limits.

5. The method of claim 3 wherein said aft securing means is hydraulicly or electrically adjustable.

* * * * *